US008904935B1

(12) United States Patent
Brown et al.

(10) Patent No.: US 8,904,935 B1
(45) Date of Patent: Dec. 9, 2014

(54) HOLDER THAT CONVERGES JETS CREATED BY A PLURALITY OF SHAPE CHARGES

(71) Applicants: Lance Brown, La Plata, MD (US); Keith Chamberlain, Indian Head, MD (US); Gordon Banks, Alexandria, VA (US)

(72) Inventors: Lance Brown, La Plata, MD (US); Keith Chamberlain, Indian Head, MD (US); Gordon Banks, Alexandria, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 32 days.

(21) Appl. No.: 13/986,709

(22) Filed: May 3, 2013

(51) Int. Cl.
*F42B 3/08* (2006.01)
*F42B 3/10* (2006.01)

(52) U.S. Cl.
CPC .... *F42B 3/08* (2013.01); *F42B 3/10* (2013.01)
USPC ..... 102/310

(58) Field of Classification Search
USPC ..... 102/306, 307, 308, 209, 310, 476; 86/50
See application file for complete search history.

(56) References Cited

U.S. PATENT DOCUMENTS

| | | | | |
|---|---|---|---|---|
| 2,984,307 | A * | 5/1961 | Barnes | 175/4 |
| 3,016,014 | A | 1/1962 | Lebourg | |
| 4,609,057 | A | 9/1986 | Walker et al. | |
| 6,494,139 | B1 * | 12/2002 | Powell | 102/310 |
| 7,172,023 | B2 * | 2/2007 | Barker et al. | 166/297 |
| 7,536,956 | B2 | 5/2009 | Sammons et al. | |
| 7,779,760 | B2 * | 8/2010 | Konig | 102/476 |
| 7,913,758 | B2 * | 3/2011 | Wheller et al. | 166/259 |
| 8,006,621 | B1 | 8/2011 | Cherry | |
| 8,327,746 | B2 * | 12/2012 | Behrmann et al. | 89/1.15 |
| 2005/0126420 | A1 * | 6/2005 | Givens et al. | 102/310 |

OTHER PUBLICATIONS

History of the Shaped Charge Effect, p. 29-30, http://www.dtic.mil/cgi-bin, Mar. 30, 1990.
Manual for Shaped-Charge Design, by Robert A. Brimner, Jul. 1, 1982, http://www.dtic.mil/cgi-bin.
Exploding Bridge Wire, http://www.enotes.com/topic/Exploding-bridgewire_detonator.

* cited by examiner

*Primary Examiner* — James S Bergin
(74) *Attorney, Agent, or Firm* — Fredric J. Zimmerman

(57) ABSTRACT

A shape charge holder includes a platform where all the charges are symmetrically positioned about equidistance from each adjacent charge and about an equal distance from a center point. The center point is generally the centroid of the platform. The holder has an explosive bridge fixture which enables simultaneous detonation of at least three shape charges. The charges are angularly mounted in sockets having holes through the platform. When detonated, each jet formed by the exploding shape charge proceeds to a convergence point located orthogonal to the platform. The holder includes a supporting structure that establishes a standoff distance of the platform/charges from a target. In operation, the explosive fixture is attached to each charge and is filled with an explosive that extends to each charge. The explosive fixture includes a single igniter assuring that when the explosive is detonated, so are the shape charges.

17 Claims, 5 Drawing Sheets

| length of linear segment | length of center of charge to centroid | tan | radians | degrees of tilt |
|---|---|---|---|---|
| 8.00 | 2.14 | 0.27 | 0.26 | 14.98 |
| 8.00 | 3.14 | 0.39 | 0.37 | 21.43 |
| 8.00 | 4.14 | 0.52 | 0.48 | 27.36 |
| 10.00 | 2.14 | 0.21 | 0.21 | 12.08 |
| 10.00 | 3.14 | 0.31 | 0.30 | 17.43 |
| 10.00 | 4.14 | 0.41 | 0.39 | 22.49 |
| 12.00 | 2.14 | 0.18 | 0.18 | 10.11 |
| 12.00 | 3.14 | 0.26 | 0.26 | 14.66 |
| 12.00 | 4.14 | 0.35 | 0.33 | 19.03 |

*FIG. 4*

HOLDER THAT CONVERGES JETS CREATED BY A PLURALITY OF SHAPE CHARGES

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION

1. Field of the Invention

The invention relates generally to shape charges and the jets created by them, and more particularly to a shape charge holder that can effect the simultaneous detonation of three or more shape charges, therein creating jets that converge at a point within a target.

2. Background

The NAVORD REPORT 1248, a MANUAL FOR SHAPED-CHARGE DESIGN By Robert A. Brimner, intended for the practical designer of shaped charges, is a scientific treatise on the art of making shape charges. It contains multiple passages on how the effectiveness of charges can be negatively impacted by a number of factors. The factors include casting imperfections, such as bubbles, and the location of the bubbles. Bubbles near the base of the liner are much more troublesome than if they occur close to or at the apex. Near the liner bubbles reduce penetration, while near the apex little harm is done.

The report teaches that cone inclination and charge axis may be inclined only 0.5 degrees with respect to each other without causing serious impairment of the jet formation and subsequent penetration.

A cone may show an ellipticity of 1 percent of the cone diameter without significant effect on the performance. A difference of 1.7 percent results in a decrease of more than 10 percent in penetration.

A triangularly deformed cone showing a difference of as much as 1 percent of the base diameter gives a penetration 10 percent below the normal. A difference of 0.5 percent may be tolerated without significant harmful effect.

An off-center placement of the detonator displacement (10 percent of the charge diameter) will cause scattering of the jet and a decrease in the depth of penetration unless the charge is very long.

Wires, rods, and other solid inert materials in the cavity of the cone adversely affect penetration by interfering with the jet formation.

SUMMARY OF THE INVENTION

The disclosed invention, in one aspect, is a shape charge holder that converges jets formed by three or more shape charges, where the shape charges are simultaneously detonated, therein each creating a jet. The holder has a platform where generally all the charges are symmetrically positioned about equidistance from each adjacent charge and about an equal distance from a center point, where the center point is generally the centroid of the platform. The charges are angularly mounted in sockets having holes through the platform. When detonated each jet formed by the exploding shape charge proceeds to a convergence point located orthogonal to the platform. The shape charges have an angular tilt relative to a common linear segment, where the common linear segment has a length as measured from the center point to a convergence point of the jets. In an exemplary embodiment, there are three shape charges, each located in an angled socket on a planar platform, such as a substantially equilateral triangular base. All the shape charges are positioned, distributed about equidistance from each other and about the same distance to the platform's centroid, which is coincident with the center point. The common linear segment extends perpendicularly from the platform's centroid until it reaches the convergence point, where the convergence point is generally within a target, or proximate to an outer surface of the target. In another exemplary embodiment having four shape charges, each charge is located in an angled socket proximate to a vertex of a square base, where all the shape charges are about equidistance from each other and about the same distance from the square platform's centroid.

The distance from the center point to all the charges does not have to be same, If this distance is different, then the angular tilt of the shaped charge will have to be adjusted to insure that the jet is properly aimed at the convergence point. Another potential problem arises if the distance from the center point to each charge is not identical, then changing the angular tilt also changes the time required for a jet to reach the convergence point. If the angle is smaller, it will reach the convergence point early and not converge with the other jets. If the angle is larger, then that jet will be late. The Applicant appreciates that in some circumstances staggering the arrival of jets may be desired. If this situation exists, then this situation may be affected by changing the angle of tilt along with the distance from the center point.

The holder, in a second exemplary aspect, includes a platform with three or more angled sockets, where each angled socket has a hole with an axial bore. The axial bore is generally angled such that an axis of the bore of each socket intercepts the common linear segment at the convergence point. Each angled socket may also have a guide sleeve with a sloped rim, where the sloped rim establishes an angle of tilt of the shape charge so that it is properly aimed at the convergence point.

A third aspect of the invention is that each shape charge is substantially cylindrical and is individually seated/mounted in its own charge receptacle. The charge receptacle has a shelf that contacts the sloped rim of the guide sleeve, and each charge receptacle is mounted in one of the angled sockets. On ignition the shape charges simultaneously detonate, and the resulting emitted jets are appropriately angled with respect to the common line segment. Each jet is tilted from perpendicular such that cumulatively all jets are aimed at and will rapidly propagate to the convergence point. The convergence point, as previously discussed, is generally within the target, and usually proximate to the outer surface of the target. At the point of convergence, the converging jets cumulatively form an intensified spawned jet that has more concentrated energy, greater penetration, and a stronger shockwave with an elevated temperature. The elevated temperature is hot enough to vaporize many materials enabling the possibility that the vaporized materials also burn therein producing additional energy. The convergence point is generally selected inside the target, in-part, to maximize the effect of the shaped charge spawned jet.

The shape charges have an optimum stand-off distance from the target where the optimum stand-off distance is function of the properties of the charges and the target. The holder includes structural supports for the platform therein the charges mounted on the platform are positioned within an acceptable range of the optimum stand-off distance. The angle of the tilted shape charges in the receptacles is set such that for the optimum stand-off distance, all of the jets meet simultaneously and are at least proximate to the convergence point. In general, as the stand-off distance increases, the angle of tilt is decreased. It is understood that the holder is appropriately sized to accommodate at least three shaped charges.

A fourth exemplary aspect of the invention is the development of an explosive bridge fixture, where the explosive bridge fixture ensures that all shape charges are detonated simultaneously. The explosive bridge fixture helps secure the shape charges. In a departure from the prior art teaching, the invented explosive bridge fixture includes a cavity filled with a powerful explosive in communication with the shape charges and a single ignition point (versus multiple electrical ignition leads to multiple charges. The explosive is selected from the group consisting of pentaerythritol tetranitrate (PETN), cyclotri-methylenetrinitramine (RDX), and military high explosives that are powerful and brisant. The cavity of the explosive bridge fixture may be accessed to facilitate loading the explosive. In one exemplary variation, there is a covering element and a channeled element. The channeled element has a plurality of extensions where there is an extension for each charge. Each extension has an arched channel and a connecting end that functions to secure the explosive bridge fixture to a shape charge, where the connection provides a route to funnel explosive material to the connected shape charge. The connecting end generally enables an integral locking connection with the shape charge. The covering element of the bridge fixture encases the explosive material in the channeled element, and in one variation the covering element has a hollow hub element through which additional explosive may be added to the channel. The hollow hub element may house the ignition source and other axial elements may be fastened. The covering element encloses the channeled element and adds strength to the explosive bridge fixture, and therein further stabilizes the position of the shape charges. The single ignition source to the explosive in the explosive bridge fixture ensures that all the shape charges detonate at the same time, thus substantially producing simultaneous convergence of the jets.

BRIEF DESCRIPTION OF THE DRAWINGS

The foregoing invention will become readily apparent by referring to the following detailed description and the appended drawings in which:

FIG. 4 is a table illustrating the relationship of the positioning of the shape charges, the angle of tilt and the length of the line segment.

DETAILED DESCRIPTION OF THE INVENTION

The illustrated invented holder has a novel explosive bridge fixture, which enables the substantially simultaneous detonation of three or more shape charges. The shape charges are angularly positioned in a platform that is offset from the target with structural supports. The charges mounted on the platform are positioned within an acceptable range of the optimum stand-off. Positioning and standoff enables all the jets to be focused at the convergence point. In application, the convergence point is generally somewhere within the target. The control over detonation, positioning and standoff results in the approximate simultaneous arrival of all the jets 50 at a relatively precise time and location point. At a relatively precise time, the converging jets cumulatively form an intensified spawned jet that has more concentrated energy, greater penetration, and a stronger shockwave with an elevated temperature. The elevated temperature is hot enough to vaporize many materials enabling the vaporized materials to also burn producing additional energy.

Figure 1:
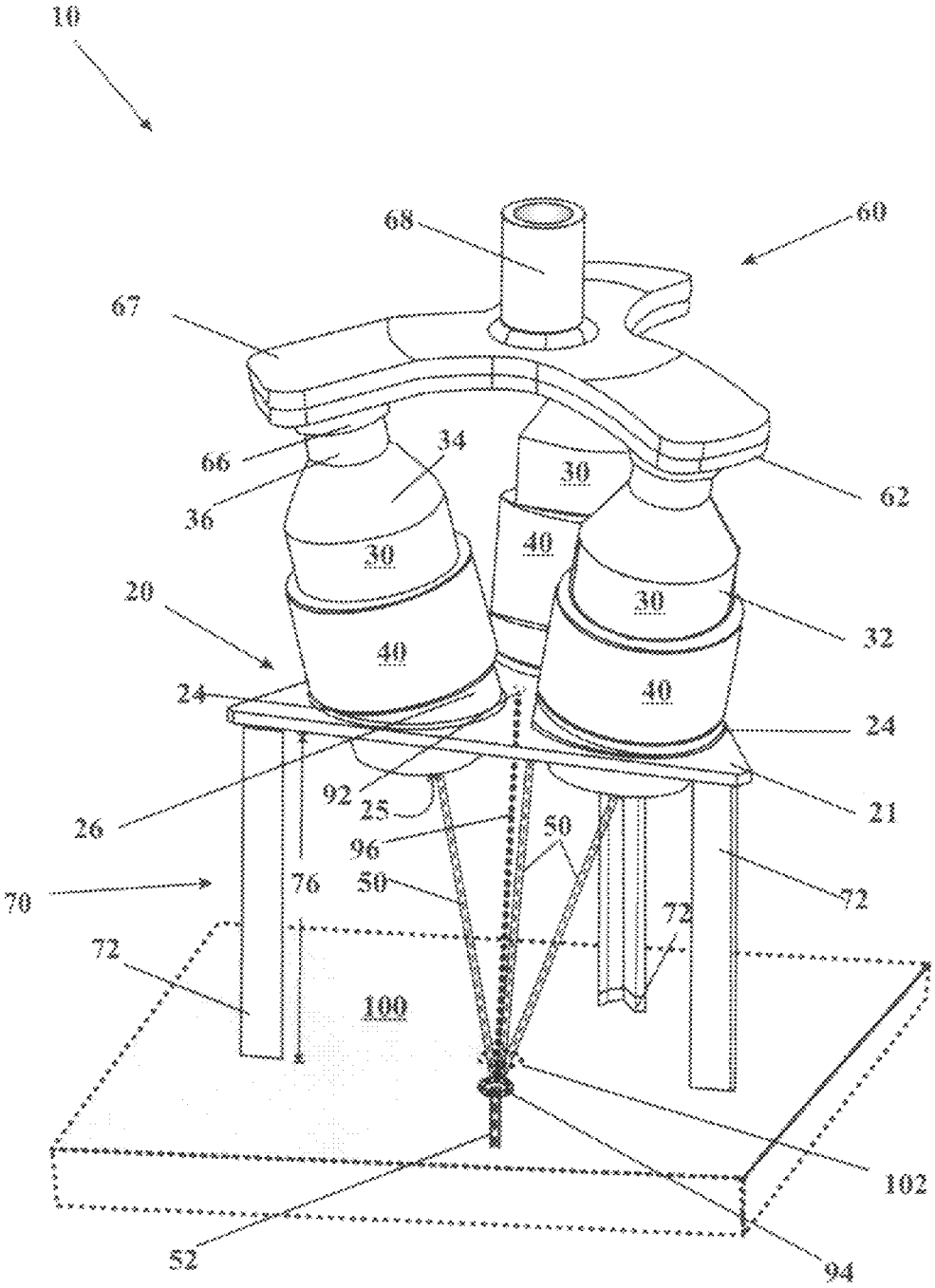
FIG. 1 is a perspective side view of an exemplary embodiment of the invention, a shape charge holder that can effect the simultaneous detonation of three or more shape charges, therein creating jets that converge at a point within a target.

Referring to FIG. 1, which is a perspective side view of a three shape charge holder 10, the holder 10 has a platform 20 with a plurality of angled sockets 24 that are symmetrically positioned about equidistance from each adjacent charge and about an equal distance from a center point, where the center point is generally the centroid 92 of the platform 20. Each socket has a hole 22 (see FIG. 2) with an axial bore 25, where the axial bore is substantially angled such that the jet 50 from the shaped charge 30 seated in the socket 24 intercepts a common linear segment 96 at the convergence point 94. The sockets 24 are distributed substantially equidistant from each other, and from a centroid 92 for the platform 20, which is substantially a triangle 21. In the illustrated exemplary embodiment, each angled socket 24 has a guide sleeve 26 with a sloped rim 28 (see FIG. 2), where the slope of the rim 28 is selected to help establish an angle of tilt (previously referred to as the angular position) of the shape charge 30. Each socket 24 is fitted with a charge receptacle 40, where each charge receptacle 40 holds a shaped charge 30 by its cylindrical body 32 and base. The charge receptacle has a necked-in region on which rests the charge's base. As illustrated, the necked-in region functions as a shelf 42 (see FIG. 2) that contacts the sloped rim 28 of the guide sleeve 26, and each charge receptacle is mounted in one of the angled sockets 24. The fixed angle of each seated shape charge mounted in its socket may be fine tuned through the use of shim rings (not shown) positioned between the sloped rim (see FIG. 2) of the guide sleeve 26 and the shelf 42 (see FIG. 2) of the charge receptacle 40. It is also anticipated that the angle of tilt may be confirmed using a laser beam tool.

Figure 2:
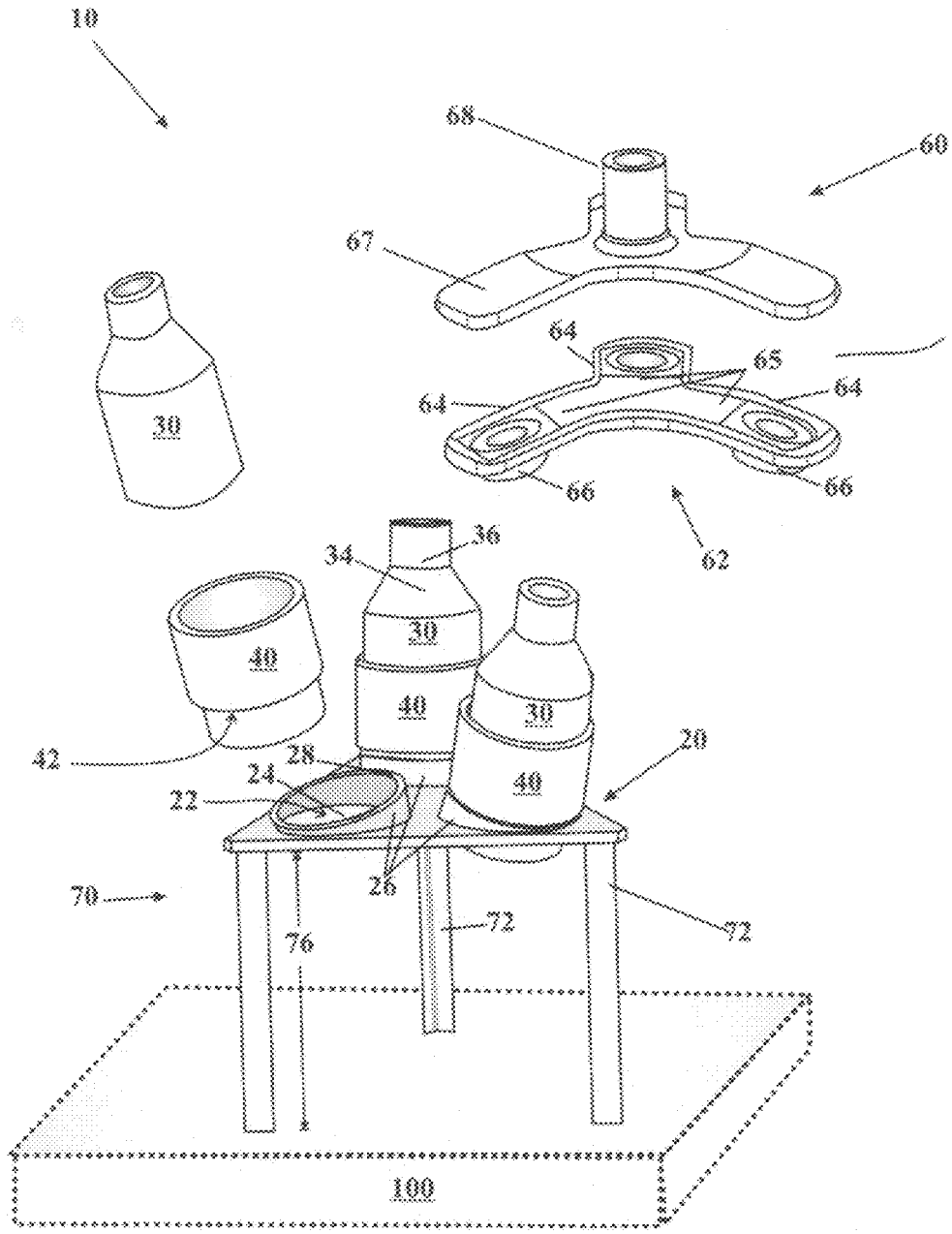
FIG. 2 is a partially exploded perspective substantially overhead view of the invention illustrated in FIG. 1.

Referring to FIG. 1 and FIG. 2, the holder 10 has an explosive bridge fixture 60, where the explosive bridge fixture ensures that all shape charges are detonated simultaneously, and the fixture helps secure the alignment of the shape charges mounted in the charge receptacles in the platform's sockets. The invented explosive bridge fixture 60 has a cavity filled with a powerful explosive (such as PETN- or RDX-based explosive) in communication with the shape charges and a single ignition point. In FIG. 2, the explosive bridge fixture 60 is shown as separated components. The cavity of the explosive bridge fixture may be accessed by removing a covering element 67, exposing an interior of a channeled element 62. The channeled element has a plurality of extensions 64. There is one extension for each charge 30. Each extension 64 has an arched channel 65 and a connecting end 66 for receiving the explosive of choice. The connecting end 66 functions to secure the explosive bridge fixture to a shape charge, where the connection provides a route to funnel explosive material into the connected shape charge. The connecting end 66 enables an integral locking connection with the head 36 atop a conical portion 34 of the bylindrical body 32 of the shape charge 30. The covering element 67, when snapped on the channeled element 62 encases the explosive material in the channeled element 62. As shown in the figures, in the illustrated embodiment the covering element 67 has a hollow hub element 68 through which additional explosive (not shown) may be added to fill, completely, the arched channels 65 all the way to the heads 36 of the shape charges 30. The covering element 67 and the channeled element 62 cumulatively form the cavity. The hollow hub element 68 may house the ignition source (not shown) and other axial elements may be fastened. The cover element adds additional strength to the explosive bridge fixture, and therein further stabilizes the position of the shape charges. The explosive bridge fixture 60 has a single ignition source that ignites the explosive filling the extension channels 65 thus ensuring that all the shape charges detonate at substantially the same time.

The resulting emitted jets are angled with respect to the common line segment, each jet tilted such that cumulatively they all proceed to the convergence point.

The platform 20 has a supporting structure 70 that, in this embodiment, includes a set of legs 72 that rest on a surface 102 of the target 100. The supporting structure 70 establishes the stand-off distance 76 from the target's surface 102. The convergence point 94 is within the target, and the linear segment 96 extends from the centroid 92 past the surface to the convergence point 94. To accommodate for the difference in length from the surface and the convergence point, the supporting structure 70, that is, in this embodiment the legs 72, the legs are appropriately shortened. Each leg is substantially an assembly of overlapping elongate L-shaped elements, which may be extended or shortened. The supporting structure 70 may be selected from extendable poles, jacks or any other suitable mechanism.

Figure 3:
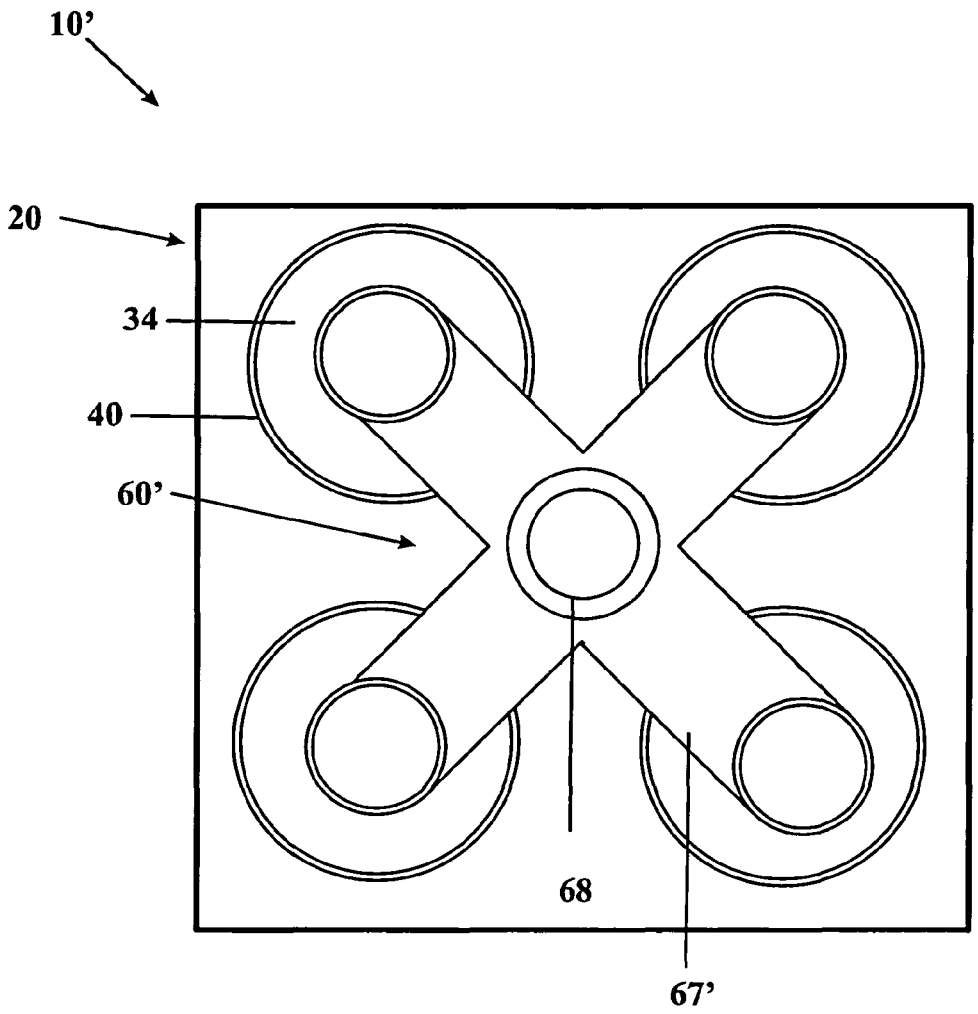
FIG. 3 is an overhead plan view of the invention that is exemplary of a four shape charge holder that can effect the simultaneous detonation of three or more shape charges, therein creating jets that converge at a point within a target.

Referring to FIG. 3, which is an overhead plan view of an exemplary four shape charge holder 10', where the four shape charge holder 10' is very similar to the three shape charge holder 10. The structural change is that the platform 20 would be larger to accommodate another similar sized shape charge, and the explosive bridge fixture 60' has four extensions 64' and a covering element 67' suitable for the channel element (not visible).

Referring to FIG. 4, which is a table that illustrates the relationship of the positioning of the shape charges, the angle of tilt and the length of the line segment. The data is sorted based on the length of the common linear segment. Recall, the common linear segment is the segment that extends from the centroid 92 to the convergence point 94. If the convergence point is located on the target surface 102, then the length of the standoff distance 76 and the linear segment 96 are the same. In an exemplary embodiment, the convergence point is beneath the surface, within the target, so the linear segment 96 is actually longer than the standoff distance, and the tilt angle has to be calculated providing for the added length. On the other hand, many exemplary embodiment target surfaces are curved. Depending on the crowning, the supporting structure 70 may or may not need adjustment. The table in FIG. 4 assumes an exemplary flat surface, and only addresses the dimensions on the platform, including the placement of the charges and how the geometric factors influence the convergence point. The trend is that relatively small changes in the distance from the centroid to the center of the charge "Δ" increase the degrees and, in particular, by a factor of 6+ degrees. Another way of looking at the data, if your convergence point is 10 on the linear segment, then you need a tilt angle of 12.08 degrees. If the tilt is wrong, and is actually 14.98, then instead of converging at length 10.00, the jet will intercept the linear segment at length 8.00.

Figure 5:
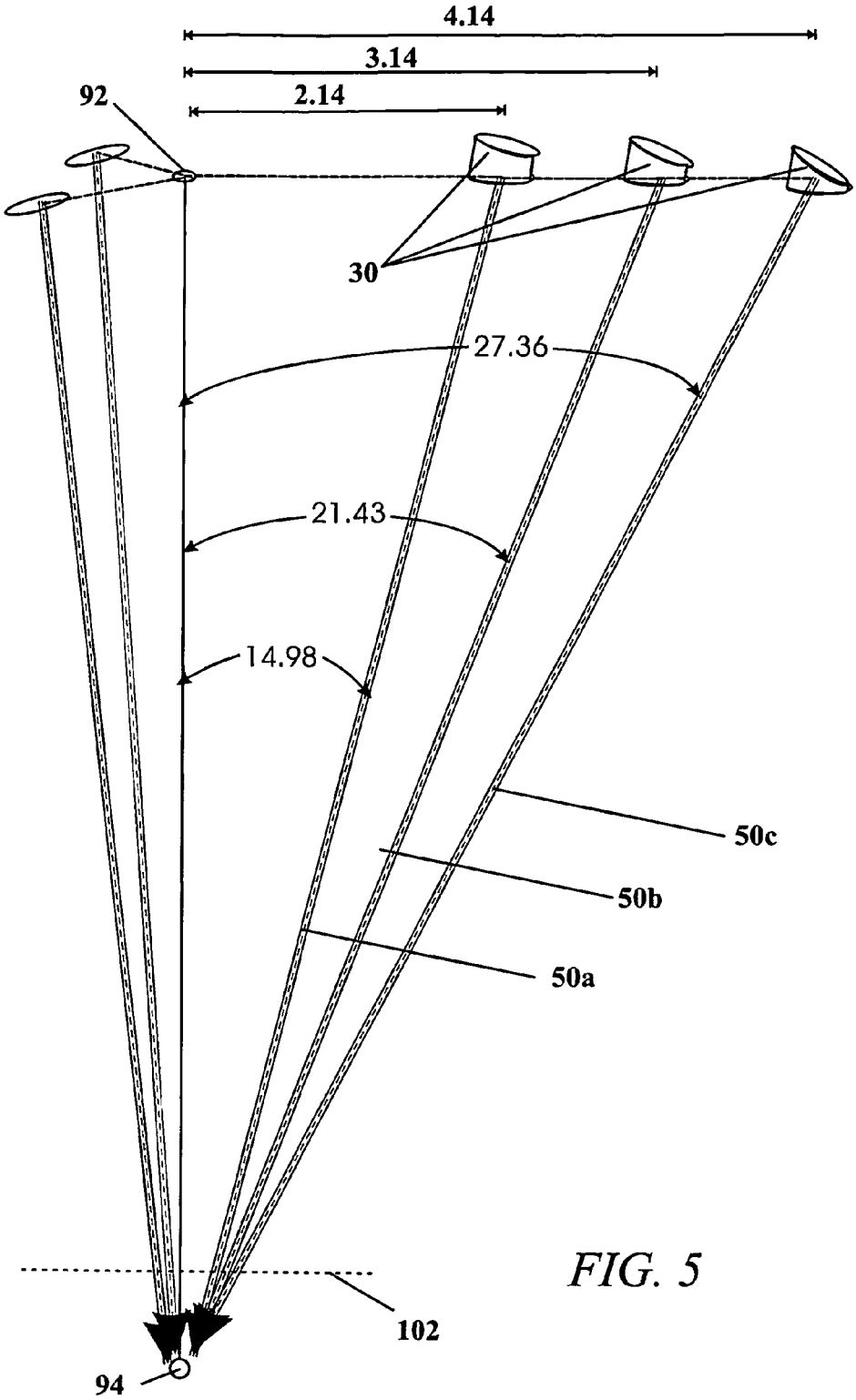
FIG. 5 is a diagrammatic view of the relationship of one of the calculated FIG. 4 embodiments.

Referring to FIG. 5, which is a line representation of the calculations shown in FIG. 4. The charges on the right are 2.14, 3.14 and 4.15 from the centroid 92 and located in same horizontal plane. The convergence point 94 is located just beneath the target surface 102. Jets 50*a*, 50*b*, 50*c* illustrate the relationship between the distance from the centroid to the center of the charge, and the angle of tilt. As seen, the greater the angle, the longer the path to the convergence point, and the greater the delay in time. In this exemplary embodiment, not all the shape charges are located the same distance from the center. Nonetheless, meeting at the convergence point is still desired. While all charges are detonated at the same time, the jets produced by those charges mounted further from the center will take longer to reach the convergence point. Therefore, the convergence will be less intense but cover a slightly longer period of time.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A shape charge holder, said holder comprising:

a plurality of at least three shape charges being angularly aimed at a convergence point, where on detonation each of the plurality of said at least three shape charges produces a jet;

a platform including angular sockets, where each of the angular sockets includes a hole through the platform, where the plurality of said at least three shape charges are symmetrically positioned, such that each of the plurality of said at least three shape charges is about equidistance from an adjacent charge and about an equal distance from a center point, where the center point is approximately a centroid of the platform;

an explosive bridge fixture enabling substantially simultaneous detonation of the plurality of said at least three shape charges, where the explosive fixture includes a cavity filled with an explosive, wherein said, cavity includes arched channels that extend and connect to said each of the plurality of said at least three shape charges with a connecting end, and wherein said cavity includes a hollow hub, which provides for an explosive and a single igniter to be mounted; and a supporting structure for placing the platform at a standoff distance from a target, wherein, on detonation the jets are substantially simultaneously produced by each of said at least three shaped charges, which are angularly aimed, and wherein said jets emanate from the platform and move to the convergence point where the jets converge.

2. The holder according to claim 1, wherein said cavity of the explosive bridge fixture is accessed by removing a covering element, exposing an interior of a channeled element, where the channeled element has a plurality of extensions, one extension for said each of the plurality of said at least three shape charges, and each extension has an arched channel and an connecting end, where the connecting end functions to secure the explosive bridge fixture to the said each shape charge, where the connection provides a route to funnel the explosive into a connected shape charge.

3. The holder according to claim 1, wherein the explosive is selected from one of the group consisting of pentaerythritol tetranitrate (PETN), cyclotrimethylenetrinitramine (RDX), and other military high explosives, which are powerful and brisant.

4. The holder according to claim 1, wherein each angled socket has a guide sleeve with a sloped rim, where the slope of the rim is selected to help establish an angle of tilt of the shape charge.

5. The holder according to claim 1, wherein the convergence point is beneath a surface of the target.

6. The holder according to claim 1, wherein the simultaneous converging of jets cumulatively forms an intensified spawned jet with concentrated energy, greater penetration, and a stronger shockwave with an elevated temperature.

7. The holder according to claim 1, wherein the holder comprises three shape charges, each located in an angled socket on a planar platform, wherein the planar platform is a substantially equilateral triangular base, where the three shaped charges are distributed about equidistance from each other and about the same distance to the platform's centroid, which is coincident with the center point.

8. The holder according to claim 1, wherein a common linear segment extends perpendicularly from the platform's centroid until it reaches the convergence point, where the convergence point is within the target, proximate to an outer surface of the target.

9. The holder according to claim 1, wherein the holder comprises four shape charges, each charge located in an angled socket proximate to a vertex of a square base, where the four shape charges are about equidistance from each other and about the same distance from the square platform's centroid.

10. A shape charge holder for converging jets produced by a plurality of at least three shape charges, comprising:

a platform including angular sockets, where each angular socket includes a hole through the platform, where the plurality of at least three shape charges are symmetrically positioned, each of the plurality of said at least three shape charge is about equidistance from an adjacent shape charge and about an equal distance from a center point, where the center point is approximately a centroid of the platform;

a guide sleeve providing for each angular socket, where the guide sleeve include a sloped rim;

a charge receptacle providing for receiving and mounting one shape charge, where each charge receptacle retains a cylindrical body and a base of said each of the plurality of said at least three shape charges, wherein the charge receptacle includes a necked-in portion, which forms an interior shelf upon which rests a charge's base and exteriorly the shelf is in contact with the sloped rim of the guide sleeve;

an explosive bridge fixture enabling substantially simultaneous detonation of the plurality of said at least three shape charges, where the explosive fixture includes a cavity filled with an explosive, said cavity includes arched channels that extend and connect to each shape charge with a connecting end, and said cavity includes a hollow hub, which provides for an explosive and a single igniter to be mounted; and a supporting structure for placing the platform at a standoff distance from a target, wherein, on detonation, the jets produced by the shape charges emanate from the platform to a convergence point, where the jets converge.

11. The holder according to claim 10, wherein said cavity of the explosive bridge fixture is accessed by removing a covering element, exposing an interior of a channeled element, where the channeled element include a plurality of extensions with one extension for each shape charge, and each extension includes an arched channel and an connecting end, where the connecting end functions to secure the explosive bridge fixture to the shape charge, where the connection provides a route to funnel the explosive into a connected shape charge.

12. The holder according to claim 10, wherein the explosive is selected from one of the group consisting of pentaerythritol tetranitrate (PETN), cyclotrimethylenetrinitramine (RDX), and military high explosives, which is powerful and brisant.

13. The holder according to claim 10, wherein the convergence point is beneath a surface of the target.

14. The holder according to claim 10, wherein the simultaneous converging of jets cumulatively forms an intensified spawned jet with concentrated energy, greater penetration, and a stronger shockwave with an elevated temperature.

15. A shape charge holder, comprising:

a plurality of at least three shape charges being angularly aimed at a convergence point, where on detonation each of said plurality of at least three shape charges produces a jet;

a platform including angular sockets, where each of the angular sockets includes a hole through the platform, where the plurality of said at least three shape charges are positioned at different distances from a center point, and each of the plurality of said at least three shape charges is individually aimed to compensate for the distance from the center point, where the center point is approximately a centroid of the platform;

an explosive bridge fixture enabling substantially simultaneous detonation of the plurality of said at least three shape charges, where the explosive fixture includes a cavity filled with an explosive, said cavity includes arched channels that extend to and connect to said each of the plurality of said at least three shape charges with a connecting end, and a hollow hub, which provides for an explosive and a single igniter is mounted;

a supporting structure for placing the platform at a standoff distance from a target, wherein, on detonation, the jets are substantially simultaneously produced by the individually aimed shape charge, where all the jets emanate from the platform toward the convergence point; and where, while all charges are detonated at the same time, the jets produced by those charges mounted further from the center take longer to reach the convergence point, and the convergence is less intense, and lasts a slightly longer period of time.

16. The holder according to claim 15, wherein said cavity of the explosive bridge fixture is accessed by removing a covering element, exposing an interior of a channeled element, where the channeled element includes a plurality of extensions, one extension for said each of said plurality of said at least three shape charges, and each extension includes an arched channel and an connecting end, where the connecting end functions to secure the explosive bridge fixture to said each of said plurality of said at least three shape charges, where the connection provides a route to funnel the explosive into the connected shape charge.

17. The holder according to claim 16, wherein the explosive is selected from one of the group consisting of pentaerythritol tetranitrate (PETN), cyclotrimethylenetrinitramine (RDX), and military high explosives, which is powerful and brisant.

* * * * *